US012733732B2

(12) United States Patent
Garrison

(10) Patent No.: US 12,733,732 B2
(45) Date of Patent: Sep. 15, 2026

(54) PROTECTIVE CASE FOR A ROUND HAIRBRUSH

(71) Applicant: Stephen Garrison, Los Angeles, CA (US)

(72) Inventor: Stephen Garrison, Los Angeles, CA (US)

( * ) Notice: Subject to any disclaimer, the term of this patent is extended or adjusted under 35 U.S.C. 154(b) by 169 days.

(21) Appl. No.: 18/648,967

(22) Filed: Apr. 29, 2024

(65) Prior Publication Data

US 2024/0358146 A1 Oct. 31, 2024

Related U.S. Application Data

(60) Provisional application No. 63/462,688, filed on Apr. 28, 2023.

(51) Int. Cl.
*A46B 17/04* (2006.01)

(52) U.S. Cl.
CPC ..... *A46B 17/04* (2013.01)

(58) Field of Classification Search
CPC ..... A46B 17/04
USPC ..... 206/361, 362.2, 362.3, 15.2, 15.3; 220/4.22, 4.23, 4.25, 4.24
See application file for complete search history.

(56) References Cited

U.S. PATENT DOCUMENTS

| | | | | |
|---|---|---|---|---|
| 1,869,753 | A * | 8/1932 | Kamm | B44D 3/125 206/361 |
| 2,782,909 | A * | 2/1957 | Mcnamara | B44D 3/125 220/802 |
| 3,127,985 | A * | 4/1964 | Scott | A46B 17/04 132/308 |
| 8,074,796 | B1 * | 12/2011 | Andrews | B65D 25/105 206/565 |
| 2002/0157978 | A1 * | 10/2002 | Roundy | B44D 3/00 206/209 |
| 2004/0200747 | A1 * | 10/2004 | McGrath | B44D 3/125 206/361 |
| 2011/0005952 | A1 * | 1/2011 | Fenn | B44D 3/125 206/361 |
| 2011/0174646 | A1 * | 7/2011 | Lai | A47K 17/00 220/677 |
| 2012/0284939 | A1 * | 11/2012 | Anderson | B65D 43/162 15/104.002 |
| 2014/0014542 | A1 * | 1/2014 | Depaola, Jr. | B44D 3/123 206/362.2 |
| 2018/0235348 | A1 * | 8/2018 | Booker | A45D 40/00 |

* cited by examiner

*Primary Examiner* — Jacob K Ackun
(74) *Attorney, Agent, or Firm* — William E. Noonan

(57) ABSTRACT

A protective case for a round hairbrush includes a generally cylindrical body having a relatively wide diameter barrel for accommodating the bristles and a relatively narrow diameter neck through which the handle of the brush extends to outside of the case. A resilient bushing is mounted in the neck to interengage the handle and restrict undue movement of the brush and resulting damage to the bristles. The body is hingedly assembled for alternating between opened and closed conditions.

20 Claims, 10 Drawing Sheets

PROTECTIVE CASE FOR A ROUND HAIRBRUSH

RELATED APPLICATION

This application claims the benefit of U.S. Application Ser. No. 63/462,688 filed Apr. 28, 2023.

FIELD OF THE INVENTION

This invention relates to a protective case for a round hairbrush, and more particularly, to a universal case for securely storing a round hairbrush during travel, shipment, and at other times when the brush is not in use.

BACKGROUND OF THE INVENTION

Round hairbrushes are extremely popular and widely used by stylists and nonprofessionals alike to blow dry and style hair. Such brushes are conventionally produced in a variety of sizes and feature an assortment of handle and bristle designs.

Currently, no known travel or storage cases have been specifically designed or made available to accommodate non-heated round hairbrushes. This can be quite inconvenient and presents a number of problems. For example, when such brushes are being brought along on a trip, they are usually packed in the traveler's luggage, either loosely or in a collapsible bag. During transport, a tightly packed suitcase is especially apt to crush and potentially damage the bristles of the brush. Moreover, if the bristles are exposed, they can snag and damage sweaters and other clothing or fabric items packed in the luggage. Hair and dandruff from the brush are also apt to create a mess within the luggage and on packed clothing. A significant need currently exists for a protective case that is capable of safely, securely, neatly, and conveniently accommodating different sizes and configurations of round hairbrushes, particularly, during travel or shipment, and likewise for securely storing such brushes at other times when they are not in use.

SUMMARY OF THE INVENTION

It is therefore an object of the present invention to provide a protective case specifically designed for a round hairbrush, which prevents damage to the bristles of the brush during travel, shipment and other periods of nonuse.

It is a further object of this invention to provide a protective case for a round hairbrush that is universal and is able to safely, snugly, and securely accommodate brushes having assorted bristle and handle diameters and lengths.

It is a further object of this invention to provide a protective travel case for a round hairbrush that reduces the likelihood that the bristles will be crushed and damages or that the bristles will damage clothing, fabrics and other items during transport.

It is a further object of this invention to provide a protective travel case for a round hairbrush that is especially well suited for conveniently and effectively packing and transporting in a traveler's luggage and especially in a tightly packed suitcase.

It is a further object of this invention to provide a protective case for a round hairbrush that is suitable for accommodating many different brands and styles of round hairbrushes.

It is a further object of this invention to provide a protective storage and travel case for a round hairbrush that securely grips brush handles having various different diameters such that the brush is held securely within the case to restrict undue movement of the brush head and potential resulting damage to the bristles.

This invention features a protective case for a round hairbrush. The case includes a hollow body having a pair of hingedly interconnected body sections that are alternatable between open and closed conditions. The body includes a barrel having a relatively wide interior compartment for accommodating the head and bristles of a round hairbrush. The body further includes a neck that is integrally connected to the barrel and has an interior channel that extends through the neck and communicates with the interior compartment of the barrel. A resilient bushing is received by the channel in the neck. The bushing includes a pair of complementary bushing sections that are connected to respective complementary body sections of the case. The bushing also includes a central passageway between the complementary bushing sections that communicates with the interior compartment of the barrel. When the body of the case is open, the barrel compartment and neck channel are exposed. The handle of a round hairbrush is inserted into the open central passageway of the resilient bushing. When the body is closed, the central passageway has a diameter that is less than the diameter of the brush handle such that the bushing resiliently grips the handle of the brush. The head and bristles of the brush are accommodated by the barrel compartment and the bushing and handle of the brush extend through and outwardly from the neck channel. Closing the complementary body and bushing sections of the case thereby secures the brush within the case.

In a preferred embodiment, the bushing includes two bushing half-sections that are interengaged with respective hingedly joined half-sections of the body. The bushing may include a generally cylindrical shape and may feature either a smooth central passageway or longitudinal elastic ribs or fingers that project radially inwardly from an interior wall that defines the central passageway of the bushing. Such ribs are resiliently compressible to accommodate brush handles having various different diameters. In alternative embodiments, the bushing may include one or more sealing membranes located at inner and outer ends or at other points along the central passageway of the bushing. Each sealing membrane resiliently grips and holds the handle of a brush received by the central passageway of the bushing when the case is closed.

The body may include an elongate pair of pivotably interconnected barrel half-sections that have a substantially cylindrical shape in the closed condition. The neck may likewise include a pair of semi-cylindrical half-sections that are pivotably interconnected to one another and extend unitarily from respective semi-cylindrical portions of the barrel. The semi-cylindrical barrel sections and semi-cylindrical neck sections may be hingedly interconnected to one another by pivot pins that are mounted to one of the barrel sections and inserted into complementary pivot pin slots carried by the other barrel section. The body may employ a closure wherein the body half-sections carry complementary closure components for releasably latching the hingedly connected body half-sections together in a closed condition. The complementary closure components may be selectively interengaged using manual/finger pressure to lock the body closed, or alternatively disengaged, again using manual finger pressure, to release the closure and open the body as required. A closure release recess may be formed in one of the barrel half-sections. When the complementary closure components are interengaged, the release recess may be manually pressed to disengage the closure components and enable the case to pivot open.

The handle retaining resilient bushing may include an inner flange that interengages a proximal end of the barrel compartment and an outer flange, which interengages and surrounds an outer end of the neck. As a result, when the case is in the closed condition, the central passageway of the bushing extends through the neck channel to communicate with the interior compartment of the barrel.

BRIEF DESCRIPTION OF THE DRAWINGS

Other objects, features and advantages will occur from the following description of a preferred embodiment and the accompanying drawings, in which.

DETAILED DESCRIPTION OF THE INVENTION

Figure 1:
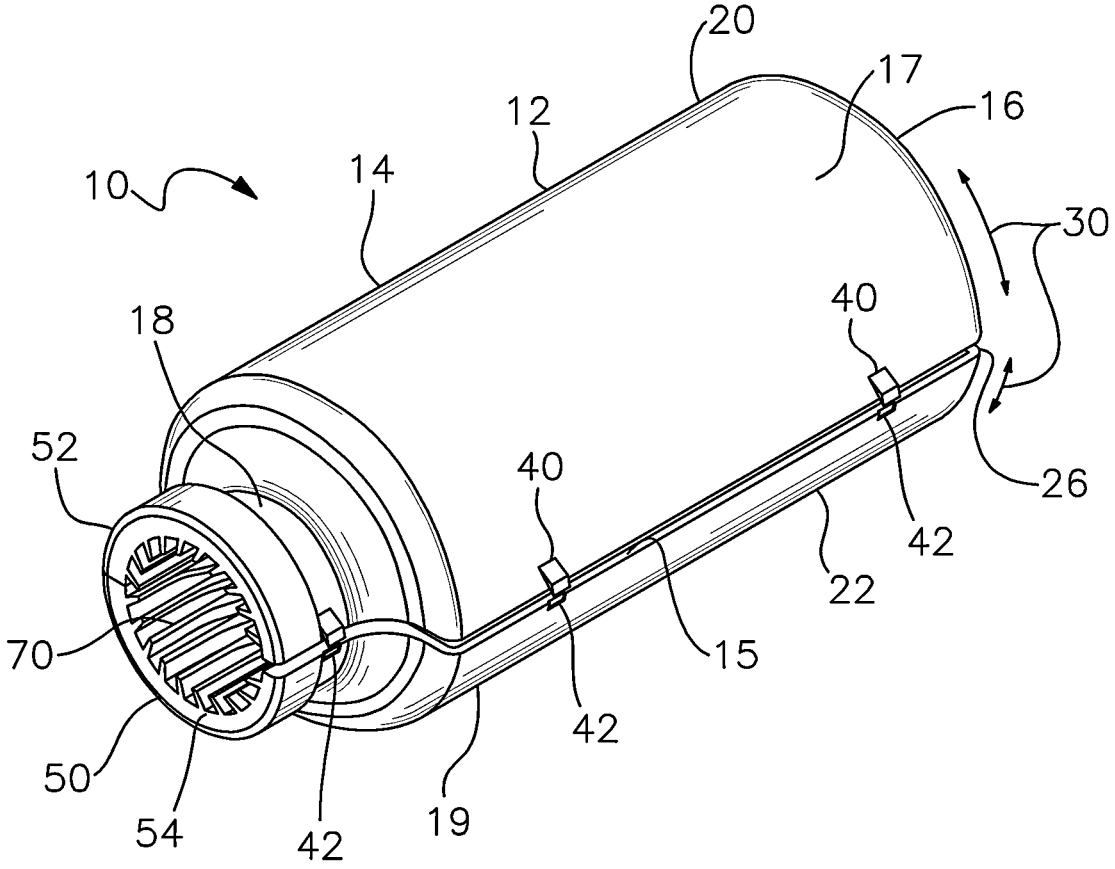
FIG. 1 is a perspective view of a preferred protective travel and storage case for a round hairbrush according to this invention, the case being empty and in a slightly open condition.
Figure 2:
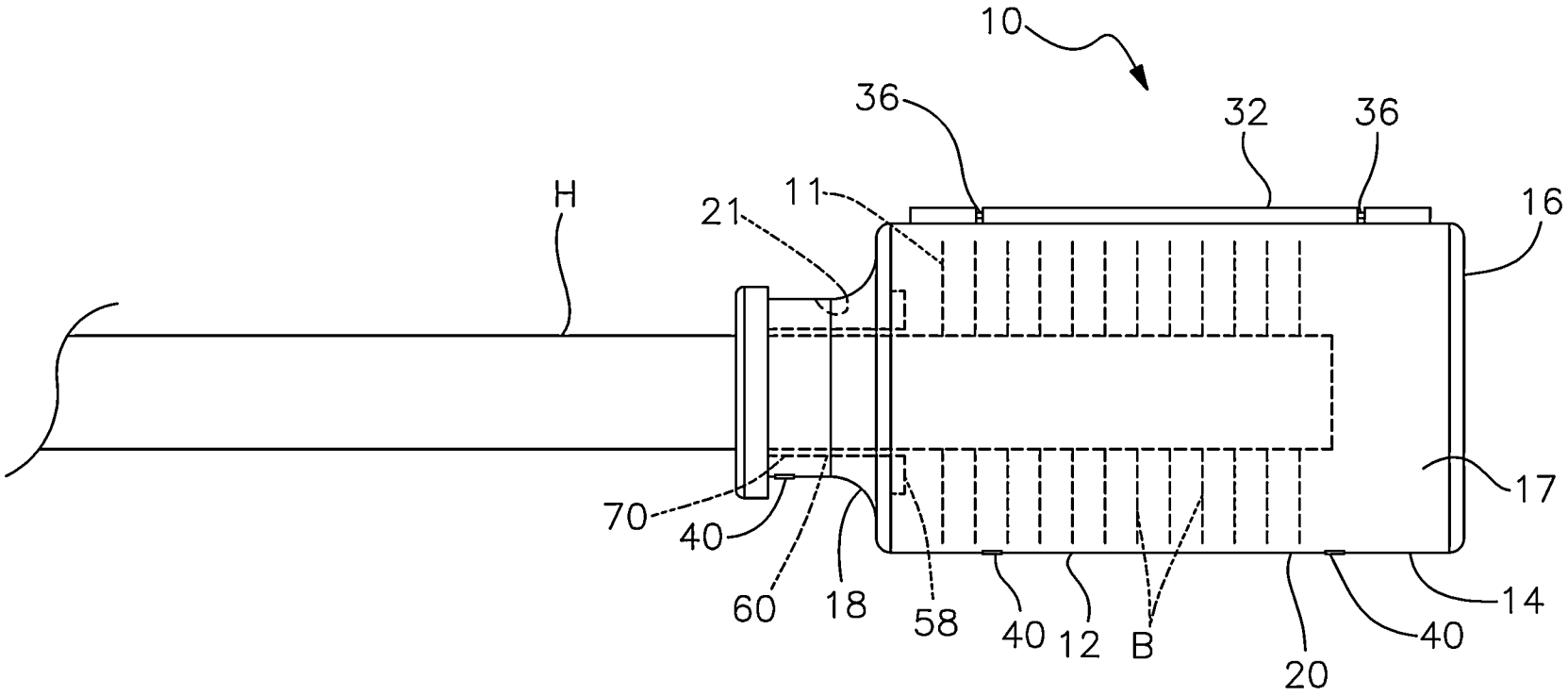
FIG. 2 is an elevational top view of the preferred hairbrush case in a closed condition and accommodating a round hairbrush that is shown in phantom.

There is shown in FIGS. 1 and 2 a protective travel and storage case 10 for accommodating a round hairbrush, which hairbrush is depicted partly in phantom in FIG. 2. As used herein, "round hairbrush" should be understood to refer to any hairbrush featuring a round, convex or generally cylindrical bristle configuration. The particular brand, style or precise configuration of the hairbrush do not constitute limitations of this invention. Moreover, case 10 is designed for holding the hairbrush virtually any time the brush is not in use, such as while it is being stored, transported during travel, shipped, etc. The case is intended for use by professional hair stylists and nonprofessionals alike.

Case 10 features a hingedly assembled body 12, which has a generally cylindrical configuration when the body is in a closed condition, as depicted in FIG. 2. Alternative closed shapes that are not perfectly cylindrical (e.g., elliptical, polygonal) may be employed within the scope of this invention. In FIG. 1, body 12 is shown in a slightly open condition to indicate the hinged nature of the body's construction. The hinged assembly is described more fully below. In the closed condition, body 12 features a generally cylindrical barrel 14 having a distal wall 16 formed at one end. A generally cylindrical neck 18 is unitarily connected to and extends proximally from barrel 14. The neck includes a central channel 21, FIG. 2, that communicates with the interior 15 of barrel 14. Barrel 14, wall 16 and neck 18 are preferably composed of a rugged plastic, which may comprise acrylonitrile butadiene styrene (ABS), Lustran® or similar material.

Body 12 and each of the foregoing segments of the body (i.e., barrel 14, floor 16 and neck 18) are comprised of a pair of complementary and hingedly interconnected sections. Preferably, the complementary sections set forth herein should be understood to comprise substantially symmetrical half-sections or semi-sections as described below. Nonetheless, the present invention should be understood to encompass alternative versions wherein the two complementary sections of the hingedly joined body 12, barrel 14, wall 16 and neck 18 (as well as the two-part bushing described below) have unequal relative size proportions (e.g., ¾-¼, ⅔-⅓ etc.).

Figure 3:
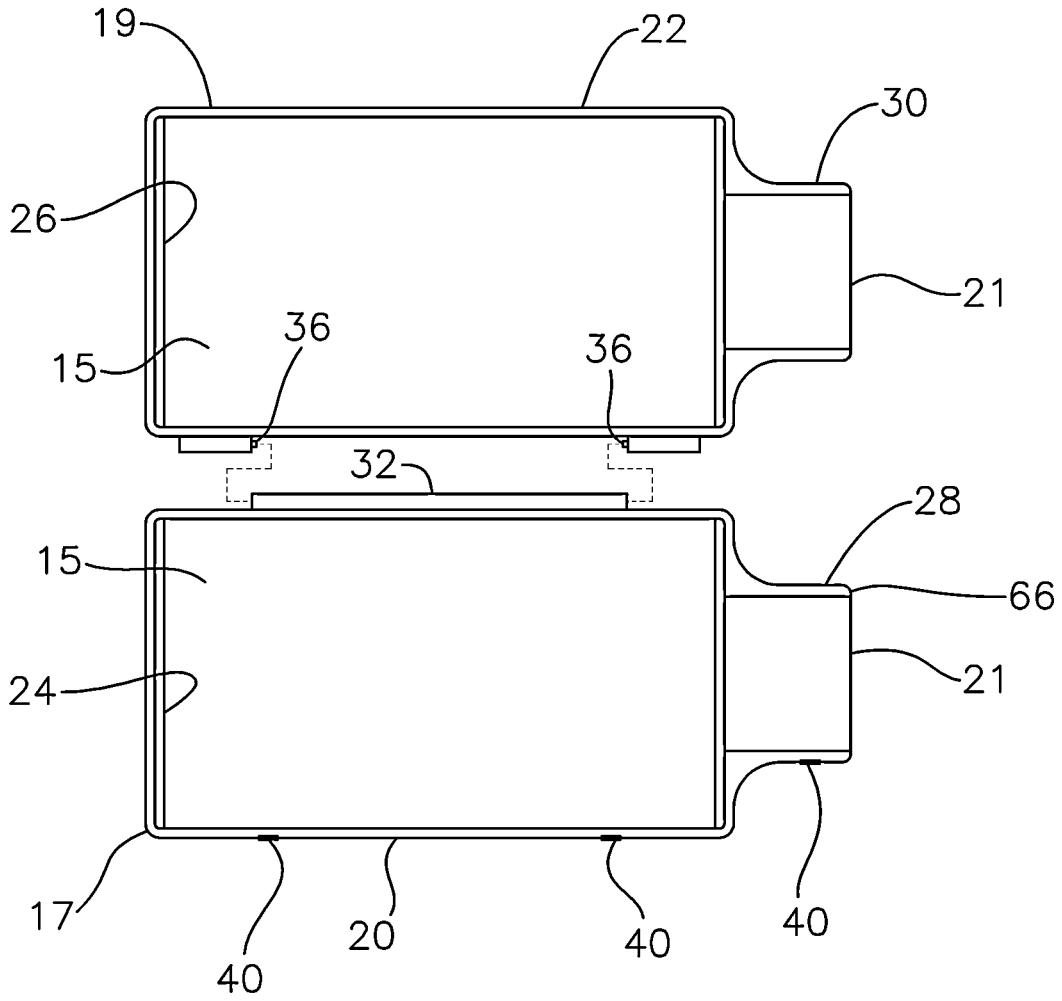
FIG. 3 is an exploded top view of the round hairbrush case body in an open condition that illustrates the interior of the body.
Figure 4:
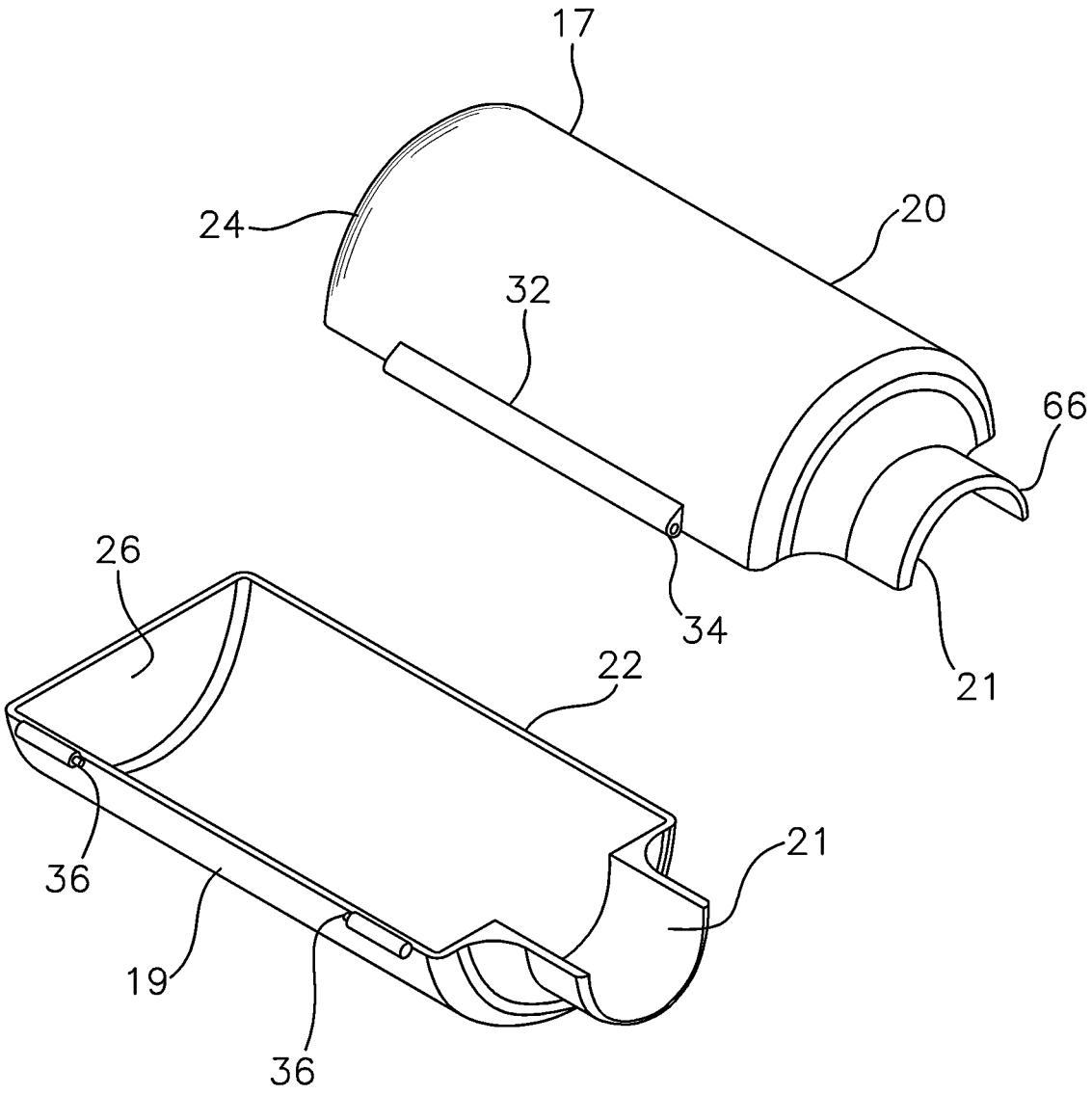
FIG. 4 is an exploded perspective view of the first and second half-sections of the hairbrush case body.

Body half-sections 17-19 are shown separated from one another for clarity in FIGS. 3 and 4. In particular, the wide diameter barrel comprises symmetrical semi-cylindrical barrel half-sections 20 and 22. Distal wall 16 comprises semicircular wall half-sections 24 and 26. Neck 18 likewise includes symmetrical opposing neck half-sections 28 and 30. Each of these half-sections is typically formed by a conventional manufacturing process such as molding or extrusion using plastic materials such as previously described.

As shown in FIGS. 1-4, case body half-sections 17 and 19 are pivotably or hingedly interconnected to permit the respective half-sections to selectively open and close relative to one another as indicated by double headed arrow 30 in FIG. 1. In particular, barrel half-section 20 carries a hinge bar 32 that is typically formed unitarily or otherwise along one longitudinal edge of half-section 20. Hinge bar 32 includes a pair of aligned pin-receiving holes 34 (see the representative hole in FIG. 4) formed respectively in opposing ends of the hinge bar. In certain embodiments, a single hole or channel may be formed continuously through the entire length of hinge 32 such that a pin-receiving opening is formed at each longitudinal end of the hinge bar. A complementary pair of hinge pins 36 are carried along a corresponding longitudinal edge of barrel half-section 22. Pins 36 are interengaged with respective holes 34 at the opposite ends of hinge bar 32 to pivotally or hingedly interconnect barrel half-section 22 to barrel half-section 20. This also hingedly interconnects entire body half-section 17 to body half-section 19. The half-sections 17 and 19 of body 12 are therefore allowed to pivotally open and close, as indicated by double-headed arrows 30 in FIG. 1. In the closed condition, barrel 12 and neck 18 form respective cylindrical portions of the case. Wall 16 likewise has a circular configuration at the distal end of body 12. In the closed condition, body 12 is latched and held closed. This is accomplished by a closure comprising resilient latching detents 40 that are carried by and extend from the lower edge of body half-section 17. More specifically, barrel half-section 20 carries a pair of spaced apart detents 40 and neck half-section 28 carries a single detent 40. When the body half-sections 17, 19 are closed as shown by FIGS. 1 and 2 and pressed together using manual finger pressure, detents 40 engage respective latching notches 42 formed in barrel half-section 22 and neck half-section 30 of body half-section 19. The detent/notch interengagement holds the case securely closed, but allows the case to be easily opened as needed using minimal finger pressure.

Figure 5:
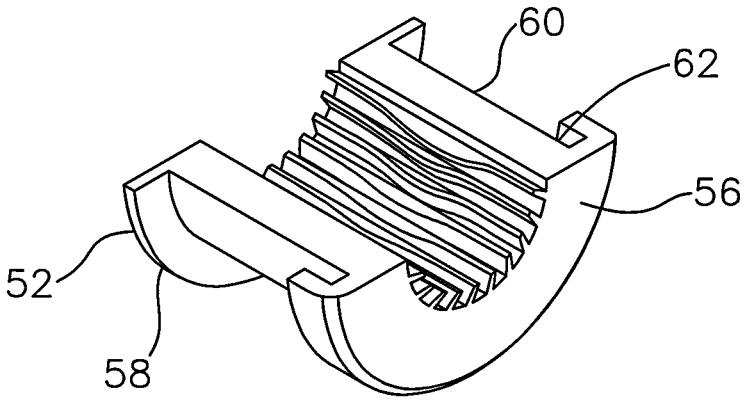
FIG. 5 is a perspective view of a representative half-section of a preferred resilient bushing employing elastic longitudinal ribs that extend radially inwardly from the interior wall into the longitudinal passageway of the bushing.
Figure 6:
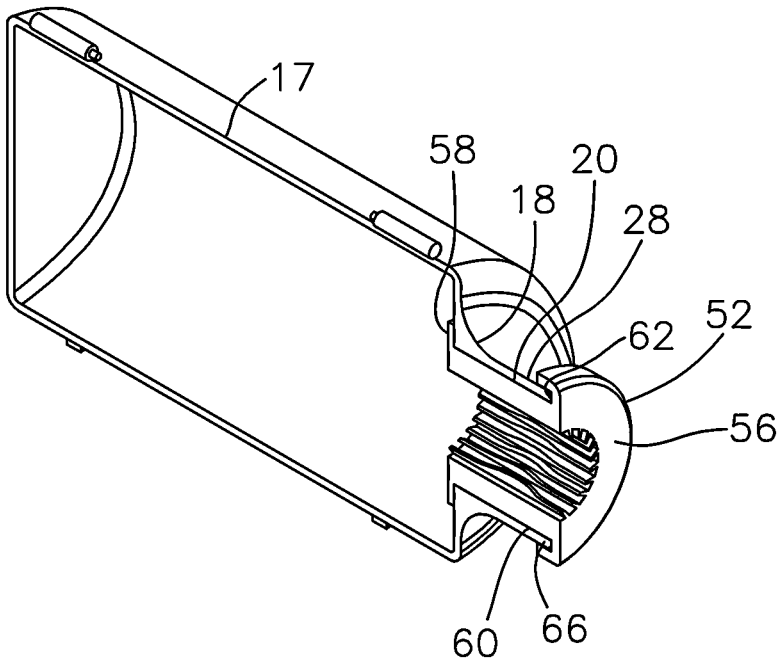
FIG. 6 is an interior perspective view of a first half-section of the hairbrush case body with a corresponding half-section of the preferred resilient bushing mounted therein.
Figure 7:
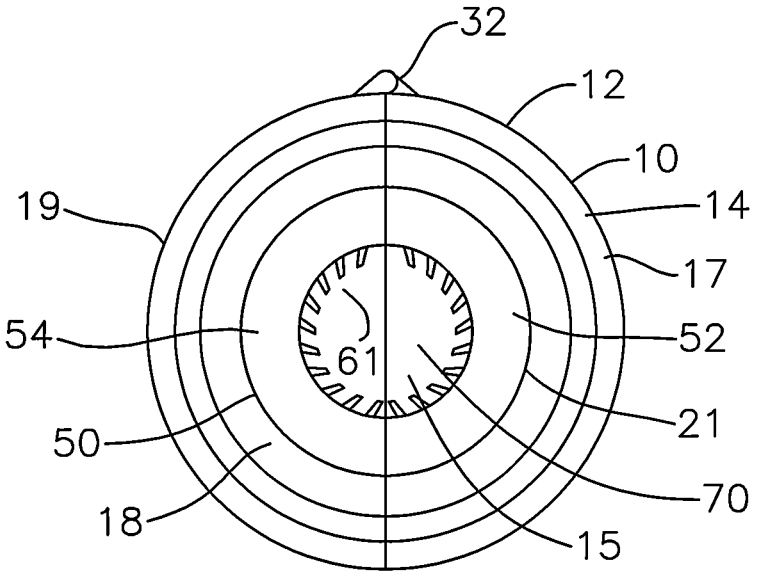
FIG. 7 is an elevational proximal end view of the protective hairbrush case with both half-sections of the resilient bushing mounted to the neck of the body.

As further shown in FIGS. 1 and 2, a resilient, handle-retaining sleeve or bushing 50 having a generally annular or cylindrical shape is mounted to case body 12 and extends through interior channel 21 of neck 18. The bushing features a central passageway 70 that forms an entry into the case and communicates with interior 15 of barrel 15. As with body 12, bushing 50 comprises a pair of discrete bushing half-sections 52, 54 (or alternative respective size-proportionate fractional annular sections) that are mounted to respective half-sections 17, 19 of body 12. A representative bushing half-section 52 is shown in FIGS. 5 and 6. Each bushing half-section comprises a resiliently compressible material such as silicone. A preferred composition is 60A durometer silicone, Elastosil® LSR. Alternative resilient materials may be employed within the scope of this invention. Each of half-sections 52 and 54 employs a symmetrical shape. In particular, each bushing half-section includes an outer flange 56, an inner flange 58 and a cylindrical intermediate portion 60 that interconnects flanges 56 and 58. Outer flanges 56 employ semi-annular grooves 62 for respectively receiving the semi-circular proximal edges of respective neck half-sections 28, 30. See, for example, entry edge 66 in FIGS. 3 and 4, which edge is received in correspondingly shaped groove 62 of bushing section 52. As shown in FIG. 5, each bushing half-section 52, 54 includes a plurality of substantially parallel inwardly projecting ribs 61 that extend longitudinally along the interior wall of the bushing half-section between opposing flanges 56 and 58 and across intermediate portion 60. When the assembled case 12 is closed, complementary bushing half-sections 52 and 54, define the longitudinal central passageway 70 (FIGS. 1, 2 and 7) through the bushing. The ribs are resiliently flexible and serve effectively to secure brush handles of various diameters within the case, as is described more fully below. Bushing passageway 70 extends through central channel 21 of neck 18, as best shown in FIGS. 2 and 7. The inner end of each bushing half-section terminates in inner flange 58, which engages an interior wall of a corresponding barrel section (20, 22) adjacent to the channel 21 through neck 18. As a result, each bushing half-section is held securely in place within a corresponding body half-section, as illustrated in FIGS. 6 and 7.

FIG. 7 depicts fully assembled case 10 with body half-sections 17 and 19 hingedly closed together. Half-sections 52 and 54 of bushing 50, which are supported by respective body half-sections 17 and 19 as previously described, are pivoted together to form a closed cylindrical bushing received by the open proximal end of neck 18. Generally circular central passageway 70 is formed longitudinally through bushing 50 such that it extends through channel 21 of neck 18 and communicates with the interior compartment 15 of barrel 14. Resilient longitudinal ribs 61 extend radially inwardly from bushing 50 into central passageway 70 to provide the passageway with an adjustable diameter for securely accommodating and holding various sizes, diameters and shapes of brush handles. The handle of a brush is held firmly in place by the compressed ribs and the bristles of the brush thereby avoid unwanted and potentially damaging interengagement with the interior cylindrical wall of closed barrel 14.

Figure 8:
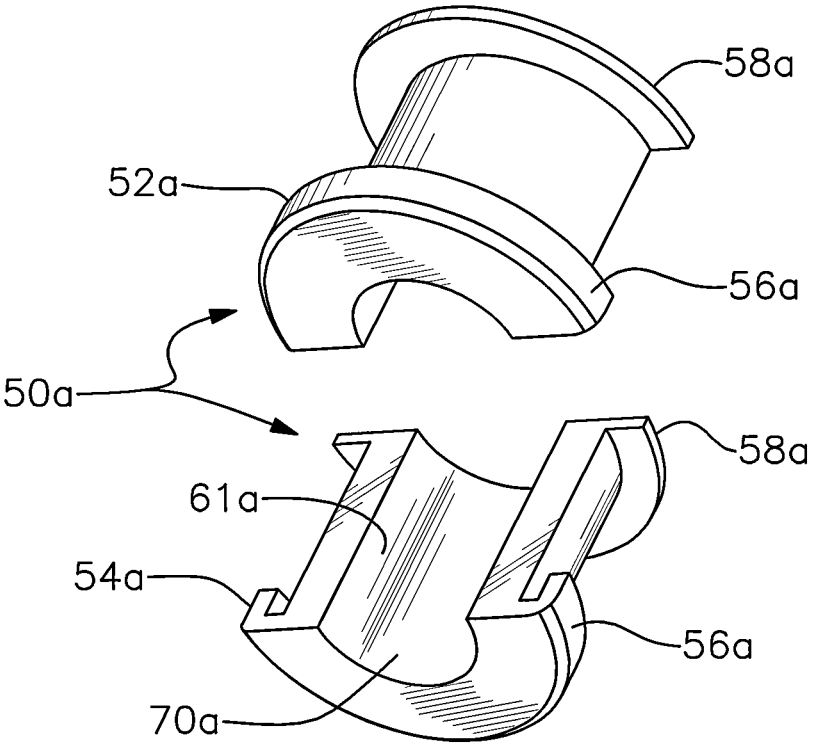
FIG. 8 is an exploded view of an alternative resilient bushing that may be used on the hairbrush case in accordance with this invention, which bushing is composed of a resiliently flexible material having a smooth passageway wall that lacks the resilient longitudinal ribs of the prior embodiment.

FIG. 8 depicts an alternative bushing 50*a*, which comprises a pair of half-bushing sections 52*a* and 54*a* analogous to those previously described. In this version, bushing 50*a* again employs an outer flange 56*a* for engaging the outer lip of the neck and an inner flange 58*a* for interengaging the interior wall of the barrel adjacent the interior channel of the neck. In this version, the interior wall 61*a* of bushing passageway 70*a* is smooth and does not include the longitudinal ribs previously described. The diameter of passageway 61*a* and resultant channel 70*a* should be sufficiently narrow to grip smaller diameter hairbrush handles. Otherwise, bushing 50*a* is composed and operates analogously to previously described bushing 50.

In operation, body 12 of case 10 is hingedly open to introduce a round hairbrush into the case. If a bushing 50, 50*a* is not already installed, the user attaches the bushing to the open neck by installing respective bushing half-sections such that they interengage the neck half-sections and the respective adjoining sections of the barrel in the manner previously described. With the body 12 in an open condition, the user introduces the brush into case 10 such that bristles B, FIG. 2, are placed within one of the barrel half-sections and the handle H extends through corresponding bushing and neck half-sections and exteriorly of the case. The case is then hingedly closed and snapped shut by interengaging detents 40 with corresponding notches 42. The distal wall 16, barrel 14 and neck 18 are thereby held securely closed. The barrel surrounds the bristles, and the neck and attached bushing surround the handle of the brush. The bushing interengages the handle with sufficient pressure to restrict movement of the bristles within compartment 15 of closed barrel 14. The brush bristles are prevented from undue interengagement with the interior walls of the case and the risk of damage to the bristles is thereby reduced significantly.

Figure 8A:
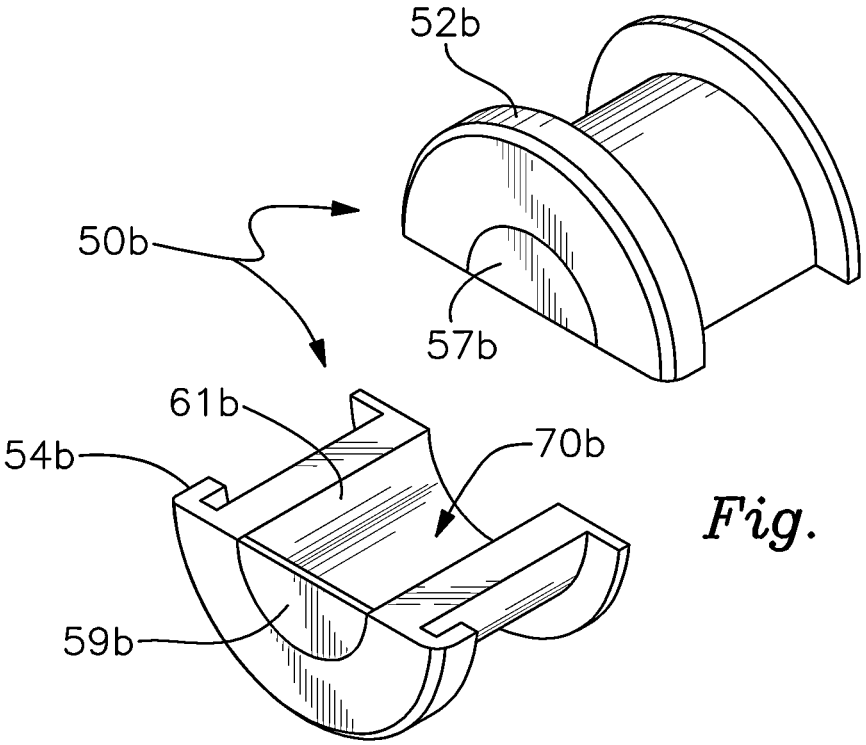
FIG. 8A is an exploded view of an alternative resilient bushing the carries resilient sealing membrane at inner and outer ends of the bushing.

The alternative bushing 50*b* shown in FIG. 8A again includes a pair of half-bushing sections 52*b* and 54*b* analogous to those previously described. In this version the interior wall 61*b* of bushing passageway 70*b* is again smooth and does not include longitudinal ribs. Bushing half-sections 52*b* and 54*b* carry respective semi-circular sealing membranes 57*b*, 59*b*, which are conformably mounted within the semi-cylindrical interior wall 61*b* defined by respective bushing half-section 52*b*, 54*b*. Each sealing membrane is composed of a resilient material and has a thickness of approximately ½ mm, although alternative thicknesses may be employed. Sealing membranes 57*b* and 59*b* are positioned such that when the half-sections of the case and supported and half-bushing sections 52*b* and 54*b* are hingedly closed, the semi-circular sealing membranes diametrically interengage. Accordingly, when a brush is received within the case and the brush handle extends through passageway 70*b* sealing membranes securely grip and hold the handle. As shown in FIG. 8A, the sealing membranes may be formed separately from and attached to the respective bushing half-sections, such as by an appropriate adhesive or heat welding process. Alternatively, the annular sealing membranes may be formed integrally or unitarily with the bushing half sections during the manufacturing process. Additional sealing membranes may also be positioned at different locations along the length of the central passageway of the bushing. In either version of this invention, the interior bushing channel should be constructed so that when the case is closed, it resiliently, snugly and securely grips the received brush handle.

Figure 9:
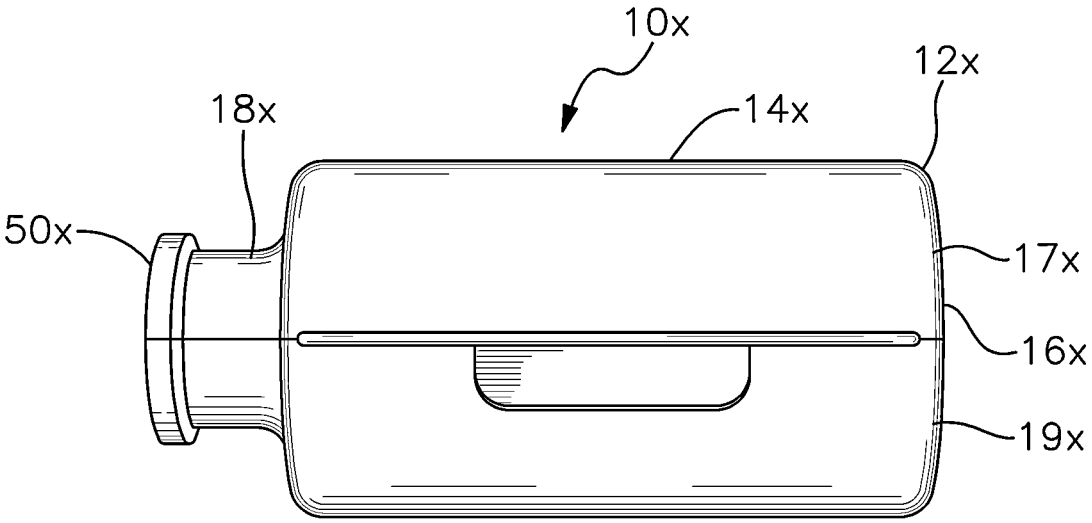
FIG. 9 is a front elevational view of an alternative preferred protective hairbrush case in accordance with this invention.
Figure 10:
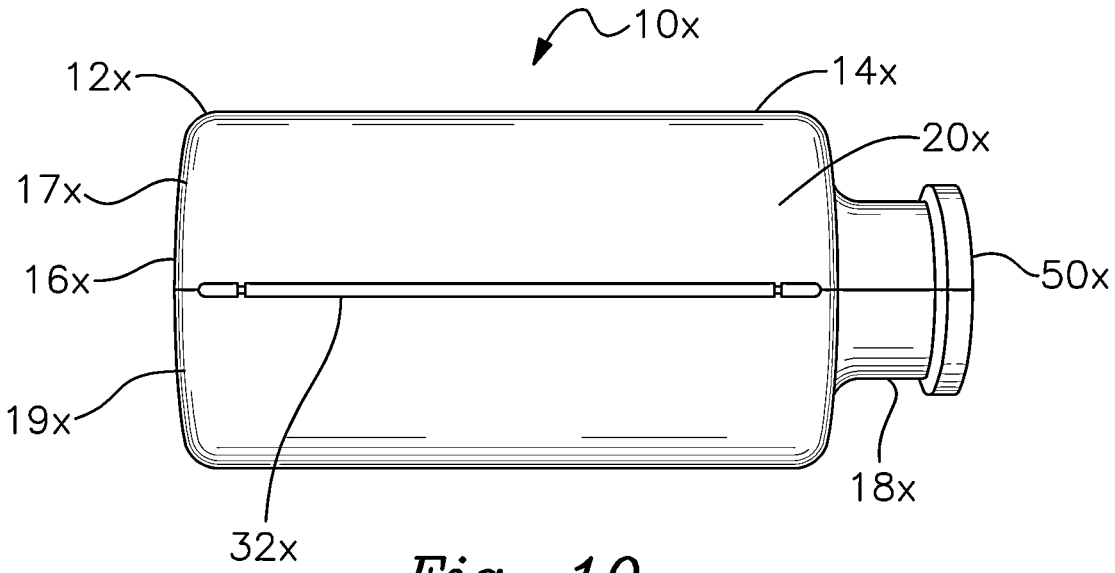
FIG. 10 is a rear elevational view of the case of FIG. 9.

FIGS. 9 and 10 show a slightly modified protective case 10*x* having a particularly preferred alternative construction. Once again, the protective case comprises a hingedly assembled body 12*x* featuring a generally cylindrical configuration in the closed condition. Body 12*x* employs a barrel 14*x*, end wall 16*x* and neck 18*x* that are composed of a rugged plastic material as previously described. A resilient handle-retaining bushing 50*x* is interengaged with neck section 18*x*, likewise as previously described.

Figure 11:
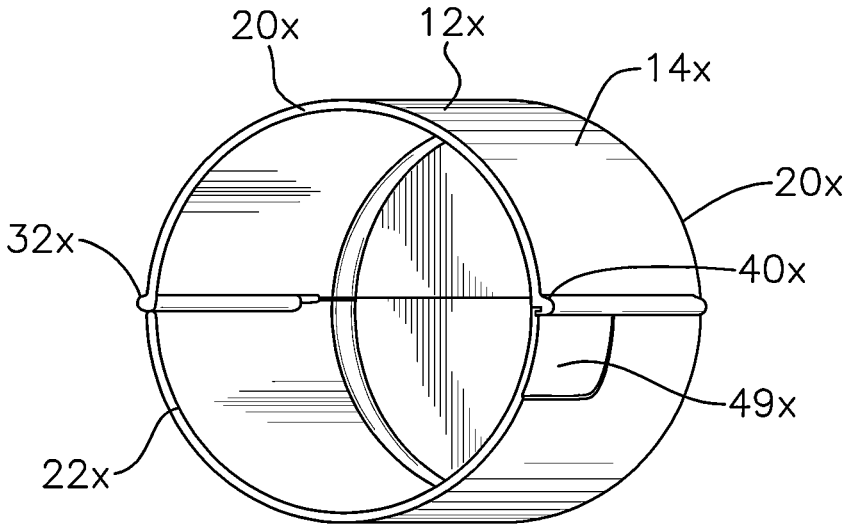
FIG. 11 is a perspective cross sectional view of the preferred case of FIGS. 9 and 10 with the body half-sections in a closed condition and specifically depicting the hinged interconnection and locking closure employed by this version.
Figure 12:
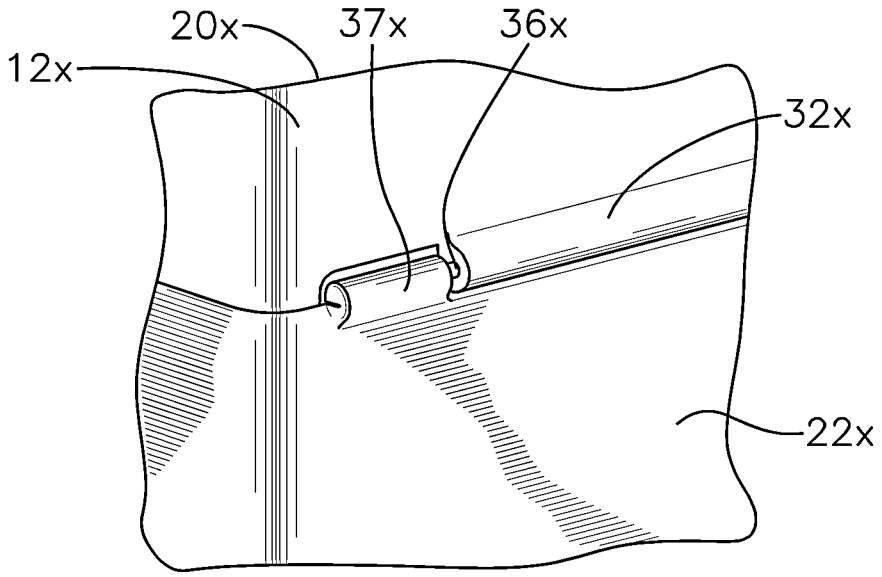
FIG. 12 is a fragmentary perspective view of one end of the hinged interconnection between the body half-sections in the version of FIGS. 9-11.
Figure 13:
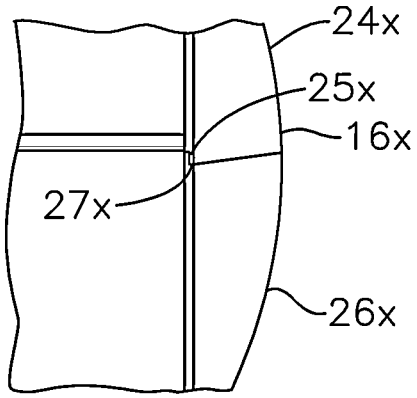
FIG. 13 is a fragmentary perspective and cross sectional view depicting the overlapping interconnection between the interengaged half barrel sections of the case.
Figure 14:
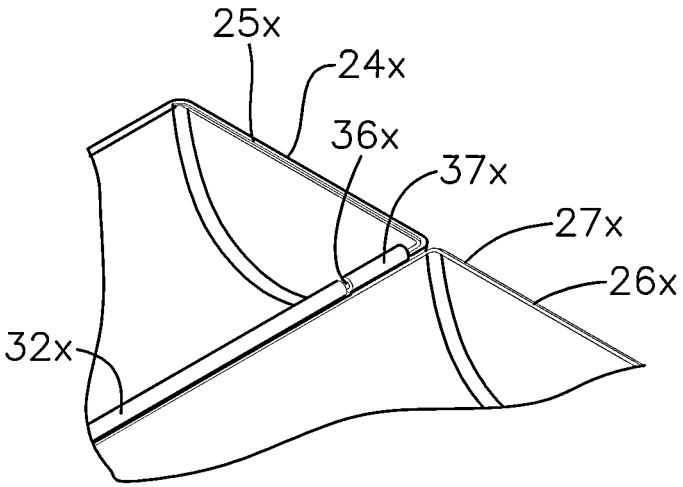
FIG. 14 is a fragmentary view of the preferred case in an open condition.
Figure 15:
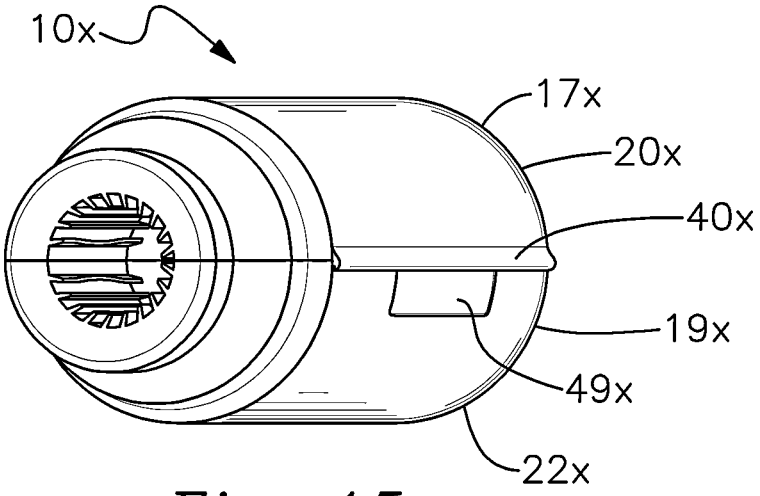
FIG. 15 is a perspective end view of the preferred case of FIGS. 9 and 10.
Figure 15A:
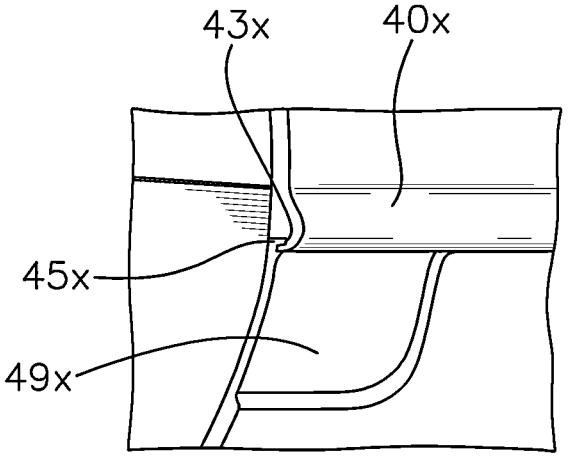
FIG. 15A is a fragmentary perspective and cross sectional view of the preferred case in a closed condition and particularly illustrating the closure and closure release recess.

The principal differences between case 10*x* and previously described case 10 reside in the modified form of interconnection and interengagement between the half-sections 17*x*, 19*x* of body 12*x*. As shown in FIGS. 10 and 11, barrel half-section 20*x* carries an elongate hinge bar 32*x* that extends along one longitudinal edge of barrel half-section 20*x*. Hinge bar 32*x* is formed unitarily with barrel half-section 20*x* and includes a smoothly rounded concave shape that facilitates opening and closing of the case. As best shown in FIG. 12, hinge bar 32*x* is interconnected by hinge pins 36*x* to corresponding hinge supports 37*x* formed unitarily in second barrel half-section 22. As best depicted in FIGS. 13 and 14, wall half-section 24*x* includes a lip 25*x* that extends along the inner diametrical edge of wall half-section 24*x*. When the case is hingedly closed, lip 25*x* symmetrically interengages a complementary channel 27*x* formed along the corresponding diametric edge of wall half-section 26*x*. As a result, the edge of wall half-section 24*x* effectively overlaps the edge of half wall section 26*x* such that the respective wall sections snugly and securely interengage when the case is closed.

Case 10*x* also includes a releasable locking closure mechanism that is modified from the previously described embodiment. In particular, as shown in FIGS. 9, 11 and 15, 15A barrel half-section 20*x* carries an elongate latch 40*x* that extends for virtually the entire length of and is unitarily attached to barrel half-section 20*x*. Latch 40*x* includes an ergonomically rounded shape and a longitudinal interior notch 43*x*, best shown in FIG. 15. Barrel half-section 22*x* carries on its corresponding edge a unitarily joined longitudinal rib 45*x* that snaps into and interengages notch 43*x* of latch 40*x* when the body half-sections 17*x*, 19*x* are hingedly closed. This securely holds the half body sections of the case in a closed and locked condition to protect a brush received within the case in a manner analogous to that previously described.

To facilitate opening of a closed and locked case, a closure release depression or recess 49*x* is formed in barrel half-section 22*x*. Recess 49*x* is a relatively resilient portion of the typically plastic case. To open the closed case, the user depresses release recess 49*x*. This flexes rib 45*x* inwardly to disengage notch 43*x*. Latch 40*x* thereby disengages rib 45*x* to unlock the case. A round hairbrush may then be inserted into or removed from the case as desired.

Otherwise, the embodiment disclosed in FIGS. 9-15A is constructed identically or similarly to the corresponding components in the earlier described embodiment. Case 10*x* thereby operates analogously to case 10 and achieves similar beneficial results. Nonetheless, the preferred embodiment represented by protective case 10*x* employs an improved ergonomic construction and better fit between the interconnected body half-sections, which provides for a smoother operation and more snug and secure closure and locking.

The case of this invention provides significant advantages for transporting and storing all varieties of round hairbrushes. Undue movement of the brush and possible damage to the bristles of the brush is avoided during travel or other transport, shipping or storage of the brush. This prolongs the useful life of the brush considerably. A further beneficial aspect of the present invention is the universal nature of the case. The barrel compartment should be sufficiently large to accommodate many, if not most, brush diameters. The neck passageway should be sufficiently large to accommodate various handle diameters. At the same time, the resilient bushing should be constructed to provide a snug fit for various sizes of handles to avoid undue movement of the brush within the case and potential damage to the bristles that may result from such movement. The closed case also effectively protects against hair and dandruff from the hairbrush dislodging from the brush and collecting on luggage and packed clothing during travel.

From the foregoing it may be seen that the apparatus of this invention provides for a protective case for round hairbrushes. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

The invention claimed is:

1. A protective case for a round hairbrush, which round hairbrush includes a handle, a head attached to a distal end of the handle and a bristles extending from the head, said case comprising:

a hollow body having a pair of hingedly interconnected body sections that are selectively alternatable between open and closed conditions; said body including a barrel having an interior compartment for accommodating the head and bristles of the hairbrush, said body further including a neck connected to said barrel, said neck having an interior channel that extends through said neck and communicates with said interior compartment of said barrel; and a resilient bushing received by said channel in said neck, said bushing including a pair of complementary bushing sections connected to respective said body sections, said bushing further including a passageway extending longitudinally therethrough between said complementary bushing sections, said passageway communicating with said interior compartment of said barrel; said bushing including a plurality of longitudinal elastic ribs that project radially inwardly from an interior wall that defines said passageway of said bushing;

said body sections being selectively opened to separate said bushing sections, whereby said interior compartment of said barrel is exposed for receiving the head and bristles of the round hairbrush and said central passageway of said bushing is exposed for receiving the handle of the round hairbrush; said body sections being selectively closed to draw together said bushing sections and said elastic ribs being resiliently compressible to accommodate the handle of the hairbrush received by said passageway when said body sections are closed, whereby the head and bristles of the round hairbrush received by said interior compartment are enclosed by said barrel and the handle of the round hairbrush received by said passageway of said resilient bushing is peripherally engaged and gripped by said bushing.

2. The case of claim 1 in which said barrel includes a pair of barrel sections and said neck includes a pair of neck sections, each said neck section being connected to a respective one of said barrel sections.

3. The case of claim 1 in which said passageway of said bushing is sufficiently narrow such that in the closed condition, said bushing sections resiliently interengage and grip the handle of the accommodated hairbrush.

4. The case of claim 1 in which said complementary bushing sections include a pair of semi-cylindrical bushing sections that are interengaged with respective said body sections.

5. The case of claim 1 in which said bushing sections interengage each other and said bushing includes a generally cylindrical shape when said body sections are closed.

6. The case of claim 1 in which said body includes an elongate pair of pivotally interconnected barrel half-sections, each said barrel half-section having a substantially semi-cylindrical shape in said closed condition.

7. The case of claim 6 in which said neck includes a pair of semi-cylindrical neck half-sections that are unitarily interconnected to and extend from respective said semi-cylindrical barrel sections.

8. The case of claim 7 in which said semi-cylindrical barrel sections and semi-cylindrical neck sections are hingedly interconnected by pivot pins mounted to one of the barrel half-sections and inserted into complementary pivot pin slots carried by the other said barrel half-section.

9. The case of claim 1 in which said body includes a closure wherein said body sections carry complementary closure components for releasably latching the hingedly connected body sections together in said closed condition.

10. The case of claim 9 in which said complementary closure components are selectively interengaged using manual pressure to latch said body sections in the closed condition and disengaged using manual pressure to release said complementary closures and allow said body section to be opened.

11. The case of claim 9 in which one of said barrel half-sections includes a flexible closure release recess that is manually pressed to disengage said complementary closure components and enable said body sections to be opened.

12. The case of claim 1 in which said resilient bushing includes an inner flange for engaging a proximal end of said barrel compartment and an outer flange for interengaging and surrounding an outer end of said neck whereby when the case is in a closed condition said central passageway of said bushing extends through said neck channel to communicate with said interior compartment of said barrel.

13. A protective case for a round hairbrush, which round hairbrush includes a handle, a head attached to a distal end of the handle and a bristles extending from the head, said case comprising:

a hollow body having a pair of hingedly interconnected body sections that are selectively alternatable between open and closed conditions; said body including a barrel having an interior compartment for accommodating the head and bristles of the hairbrush, said body further including a neck connected to said barrel, said neck having an interior channel that extends through said neck and communicates with said interior compartment of said barrel; and a resilient bushing received by said channel in said neck, said bushing including a pair of complementary bushing sections connected to respective said body sections, said bushing further including a passageway extending longitudinally therethrough between said complementary bushing sections, said passageway communicating with said interior compartment of said barrel;

said body sections being selectively opened to separate said bushing sections, whereby said interior compartment of said barrel is exposed for receiving the head and bristles of the round hairbrush and said central passageway of said bushing is exposed for receiving the handle of the round hairbrush; said body sections being selectively closed to draw together said bushing sections, whereby the head and bristles of the round hairbrush received by said interior compartment are enclosed by said barrel and the handle of the round hairbrush received by said passageway of said resilient bushing is peripherally engaged and gripped by said bushing; and said bushing including at least one pair of opposing semi-circular resilient sealing membranes mounted to respective said bushing sections in said passageway of said bushing, said opposing sealing membranes being positioned within said passageway such that said opposing sealing membranes resiliently engage and grip the handle of a hairbrush received by said passageway when said body sections are closed.

14. The case of claim 13 in which said barrel includes a pair of barrel sections and said neck includes a pair of neck sections, each said neck section being connected to a respective said barrel section.

15. The case of claim 13 in which said body includes an elongate pair of pivotally interconnected barrel half-sections, each said barrel half-section having a substantially semi-cylindrical shape in said closed condition.

16. The case of claim 15 in which said neck includes a pair of semi-cylindrical neck half-sections that are unitarily interconnected to and extend from respective said semi-cylindrical barrel sections.

17. A protective case for a round hairbrush, which round hairbrush includes a handle, a head attached to a distal end of the handle and a bristles extending from the head, said case comprising:

a hollow body having a pair of hingedly interconnected body sections that are selectively alternatable between open and closed conditions; said body including a barrel having an interior compartment for accommodating the head and bristles of the hairbrush, said body further including a neck connected to said barrel, said neck having an interior channel that extends through said neck and communicates with said interior compartment of said barrel; and a resilient bushing received by said channel in said neck, said bushing including a pair of complementary bushing sections connected to respective said body sections, said bushing further including a passageway extending longitudinally therethrough between said complementary bushing sections, said passageway communicating with said interior compartment of said barrel;

said body sections being selectively opened to separate said bushing sections, whereby said interior compartment of said barrel is exposed for receiving the head and bristles of the round hairbrush and said central passageway of said bushing is exposed for receiving the handle of the round hairbrush; said body sections being selectively closed to draw together said bushing sections, whereby the head and bristles of the round hairbrush received by said interior compartment are enclosed by said barrel and the handle of the round hairbrush received by said passageway of said resilient bushing is peripherally engaged and gripped by said bushing;

said resilient bushing including an inner flange for engaging a proximal end of said barrel compartment and an outer flange for interengaging and surrounding an outer end of said neck, whereby when the case is a closed said central passageway of said bushing extends through said neck channel to communicate with said interior compartment of said barrel.

18. The case of claim 17 in which said barrel includes a pair of barrel sections and said neck includes a pair of neck sections, each said neck section being connected to a respective said barrel section.

19. The case of claim 17 in which said body includes an elongate pair of pivotally interconnected barrel half-sections, each said barrel half-section having a substantially semi-cylindrical shape in said closed condition.

20. The case of claim 19 in which said neck includes a pair of semi-cylindrical neck half-sections that are unitarily interconnected to and extend from respective said semi-cylindrical barrel sections.

* * * * *